US011457794B2

(12) United States Patent
Fawaz

(10) Patent No.: US 11,457,794 B2
(45) Date of Patent: Oct. 4, 2022

(54) DISHWASHER WITH TUBULAR SPRAY ELEMENT DRINKWARE WASHING SYSTEM

(71) Applicant: Midea Group Co., Ltd., Foshan (CN)

(72) Inventor: Bassam Fawaz, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/189,749

(22) Filed: Mar. 2, 2021

(65) Prior Publication Data

US 2022/0280015 A1 Sep. 8, 2022

(51) Int. Cl.

| | |
|---|---|
| ***A47L 15/42*** | (2006.01) |
| ***A47L 15/46*** | (2006.01) |
| ***A47L 15/50*** | (2006.01) |

(52) U.S. Cl.

CPC ..... *A47L 15/428* (2013.01); *A47L 15/46* (2013.01); *A47L 15/50* (2013.01)

(58) Field of Classification Search

None

See application file for complete search history.

(56) References Cited

U.S. PATENT DOCUMENTS

| | | | |
|---|---|---|---|
| 5,409,545 | A | 4/1995 | Levey et al. |
| 6,581,614 | B1 | 6/2003 | Gotfried |
| 7,896,977 | B2 | 3/2011 | Gillum et al. |
| 8,349,089 | B2 | 1/2013 | Bertsch et al. |
| 9,656,304 | B2 | 5/2017 | Tiwari |
| 9,861,260 | B2 | 1/2018 | Benedict et al. |
| 9,936,854 | B2 | 4/2018 | Boyer |
| 9,962,063 | B2 | 5/2018 | Beshears, Jr. et al. |
| 10,368,718 | B2 | 8/2019 | Wilson et al. |
| 10,687,684 | B2 | 6/2020 | Wilson |
| 2008/0011338 | A1 | 1/2008 | Zhao |
| 2012/0291827 | A1 | 11/2012 | Buddharaju et al. |
| 2018/0168430 | A1 | 6/2018 | Wilson et al. |
| 2020/0085277 | A1 | 3/2020 | Digman et al. |

FOREIGN PATENT DOCUMENTS

| | | | |
|---|---|---|---|
| CN | 1552271 | A | 12/2004 |
| EP | 0631755 | A1 | 1/1995 |
| EP | 0997100 | A1 | 5/2000 |

(Continued)

OTHER PUBLICATIONS

International Search Report and Written Opinion issued in Application No. PCT/CN2021/131835, 8 pages, dated Feb. 15, 2022.

(Continued)

*Primary Examiner* — Levon J Shahinian

(74) *Attorney, Agent, or Firm* — Middleton Reutlinger

(57) ABSTRACT

A dishwasher, dishwasher sprayer, and method of spraying utilize a tubular spray element to direct a spray of fluid at one or more drinkware sprayers that are positioned within a wash tub and physically spaced apart from the tubular spray element. Each drinkware sprayer includes one or more outlets in fluid communication with a fluid collector that faces the tubular spray element and that is configured to receive the spray of fluid from the tubular spray element when the tubular spray element is rotated to a predetermined position, and route the received fluid out of the one or more outlets to wash an interior of a drinkware item that is positioned over the drinkware sprayer.

20 Claims, 7 Drawing Sheets

(56) References Cited

FOREIGN PATENT DOCUMENTS

| | | | |
|---|---|---|---|
| WO | WO2016192796 | A1 | 12/2016 |
| WO | WO2020120237 | A1 | 6/2020 |

OTHER PUBLICATIONS

Simplified Design LLC, Ben's Bottle Washer User Guide, Retrieved from: https://www.simplifieddesignllc.com/resources/Bottle%20Washer%20User%20Guide%208-15-15.pdf, dated 2014.

Yu, Johnny, Bottle Wash Jets Make a Big Splash, GE, Retrieved from: https://www.reviewed.com/dishwashers/content/ge-gdt720ssfss-review , dated Jun. 3, 2015.

Kitchenaid, Stainless Steel with Printshield Finish 46 DBA Dishwasher with Bottle Wash Option and Printshield Finish KDTE204GPS, Retrieved from: https://www.kitchenaid.com/major-appliances/dishwashers/integrated-control/p.46-dba-dishwasher-with-bottle-wash-option-and-printshield-finish.kdte204gps.html, dated 2020.

DISHWASHER WITH TUBULAR SPRAY ELEMENT DRINKWARE WASHING SYSTEM

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

It has been found, however, that for some types of utensils, e.g., bottles and other drinkware, washing the interiors of such drinkware can present challenges both for conventional spray arm systems, and even for tubular spray element-based systems, due to the relatively narrow openings of their openings, as well as the difficulty in maintaining such drinkware in appropriate washing orientations throughout an entire wash cycle. Therefore, a need continues to exist for a manner of improving washing of bottles and other types of drinkware in a dishwasher.

SUMMARY

The herein-described embodiments address these and other problems associated with the art by providing a dishwasher, dishwasher sprayer, and method of spraying in which a tubular spray element may be selectively directed at one or more drinkware sprayers that are positioned in a wash tub and physically spaced apart from the tubular spray element. Each drinkware sprayer includes one or more outlets in fluid communication with a fluid collector that faces the tubular spray element and that is configured to receive a spray of fluid from the tubular spray element when the tubular spray element is rotated to a predetermined position, and route the received fluid out of the one or more outlets to wash an interior of a drinkware item that is positioned over the drinkware sprayer.

Therefore, consistent with one aspect of the invention, a dishwasher may include a wash tub, a tubular spray element disposed in the wash tub and being rotatable about a longitudinal axis thereof, the tubular spray element including one or more apertures extending through an exterior surface thereof, and the tubular spray element in fluid communication with a fluid supply to direct fluid from the fluid supply into the wash tub through the one or more apertures, a tubular spray element drive coupled to the tubular spray element and configured to rotate the tubular spray element between a plurality of rotational positions about the longitudinal axis thereof, and a drinkware sprayer positioned within the wash tub and physically spaced apart from the tubular spray element. The drinkware sprayer may include one or more outlets in fluid communication with a fluid collector that faces the tubular spray element, and the fluid collector may be configured to receive fluid from the tubular spray element when the tubular spray element is rotated to a predetermined rotational position, and route the received wash fluid out of the one or more outlets to wash an interior of a drinkware item that is positioned over the drinkware sprayer.

Some embodiments may also include a controller coupled to the tubular spray element drive, and the controller may be configured to control the tubular spray element drive to discretely direct the tubular spray element to the predetermined rotational position to direct fluid from the fluid supply towards the fluid collector. Also, in some embodiments, the controller may further be configured to control the tubular spray element drive to discretely direct the tubular spray element to a different rotational position to direct fluid from the fluid supply towards one or more utensils in the wash tub other than the drinkware item. Further, in some embodiments, the drinkware sprayer may be supported in a rack, and the one or more utensils may be in the rack at different positions than the drinkware item.

In some embodiments, the drinkware sprayer may be supported in a first rack, and the one or more utensils may be in a second rack. In addition, in some embodiments, the controller may be configured to control the tubular spray element drive to rotate or oscillate the tubular spray element during a wash cycle, and to temporarily pause the tubular spray element drive during the rotation or oscillation of the tubular spray element when the tubular spray element is in the predetermined rotational position to direct fluid from the fluid supply towards the fluid collector.

Some embodiments may also include a rack supported in the wash tub and movable between loading and washing positions, and the drinkware sprayer may be supported by the rack. In some embodiments, the rack may be formed of coated metal wires, and the drinkware sprayer may snap onto one or more of the coated metal wires. In addition, in some embodiments, the drinkware sprayer is a first drinkware sprayer disposed at a first position on the rack, and the dishwasher may further include one or more additional drinkware sprayers disposed at a plurality of additional positions on the rack, and the one or more additional positions may be arranged such that respective fluid collectors of the one or more additional positions are configured to receive fluid from the tubular spray element when the tubular spray element is rotated to the predetermined rotational position. Moreover, in some embodiments, the first position and the one or more additional positions may be arranged along an axis that is substantially parallel to the longitudinal axis of the tubular spray element, and the one or more apertures of the tubular spray element may include a plurality of apertures that are positioned along the tubular spray element to direct sprays of fluid towards the fluid collectors of each of the first drinkware sprayer and the one or more additional drinkware sprayers.

In some embodiments, the predetermined rotational position may be a first predetermined rotational position and the drinkware sprayer may be a first drinkware sprayer disposed at a first position on the rack, the dishwasher may further include a second drinkware sprayer disposed at a second position on the rack, and the second position may be arranged such that a fluid collector of the second drinkware sprayer is configured to receive fluid from the tubular spray element when the tubular spray element is rotated to a second rotational position.

Moreover, in some embodiments, the rotational position may be substantially vertical and the fluid collector may have an opening that is substantially horizontal. In some embodiments, the rotational position may form an acute angle relative to vertical and the fluid collector may have an opening that opens toward the tubular spray element.

In addition, in some embodiments, the one or more outlets may include a top outlet that directs fluid towards a bottom interior surface of the drinkware item. In some embodiments, the one or more outlets may include a side outlet that directs fluid towards a side interior surface of the drinkware item. Moreover, in some embodiments, the one or more outlets may include a movable outlet disposed on a movable body. Also, in some embodiments, the movable body may include a rotatable body.

In some embodiments, the drinkware sprayer may include a plurality of drinkware supports configured to support a body of the drinkware item that is positioned over the drinkware sprayer. In addition, in some embodiments, the drinkware sprayer may be funnel shaped and the plurality of drinkware supports may include angled fins that support a spout of the drinkware item. Also, in some embodiments, the tubular spray element may be in fluid communication with an air supply to direct air from the air supply into the wash tub through the one or more apertures to dry the interior of the drinkware item.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
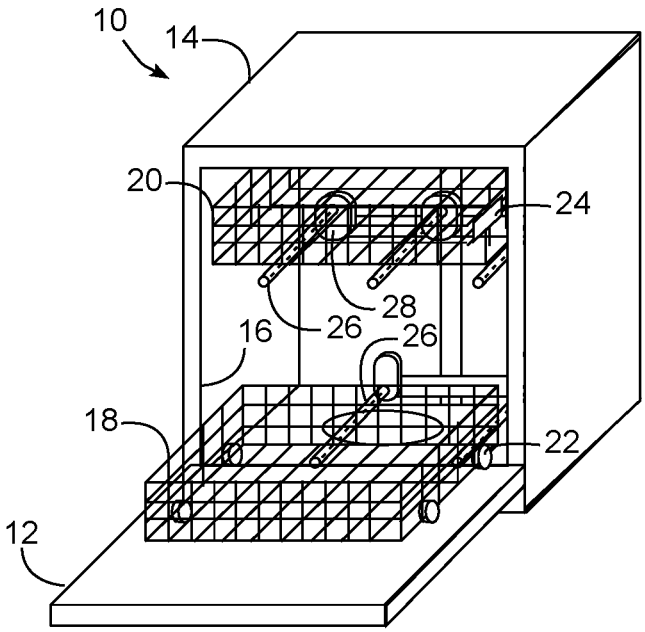
FIG. 1 is a perspective view of a dishwasher consistent with some embodiments of the invention.

In some embodiments consistent with the invention, a tubular spray element may support washing of bottles and other drinkware through the use of one or more drinkware sprayers that are positioned within a wash tub and physically spaced apart from the tubular spray element. Each drinkware sprayer includes one or more outlets in fluid communication with a fluid collector that faces the tubular spray element and that is configured to receive a spray of fluid from the tubular spray element when the tubular spray element is rotated to a predetermined position, and route the received fluid out of the one or more outlets to wash an interior of a drinkware item that is positioned over the drinkware sprayer.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number of embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
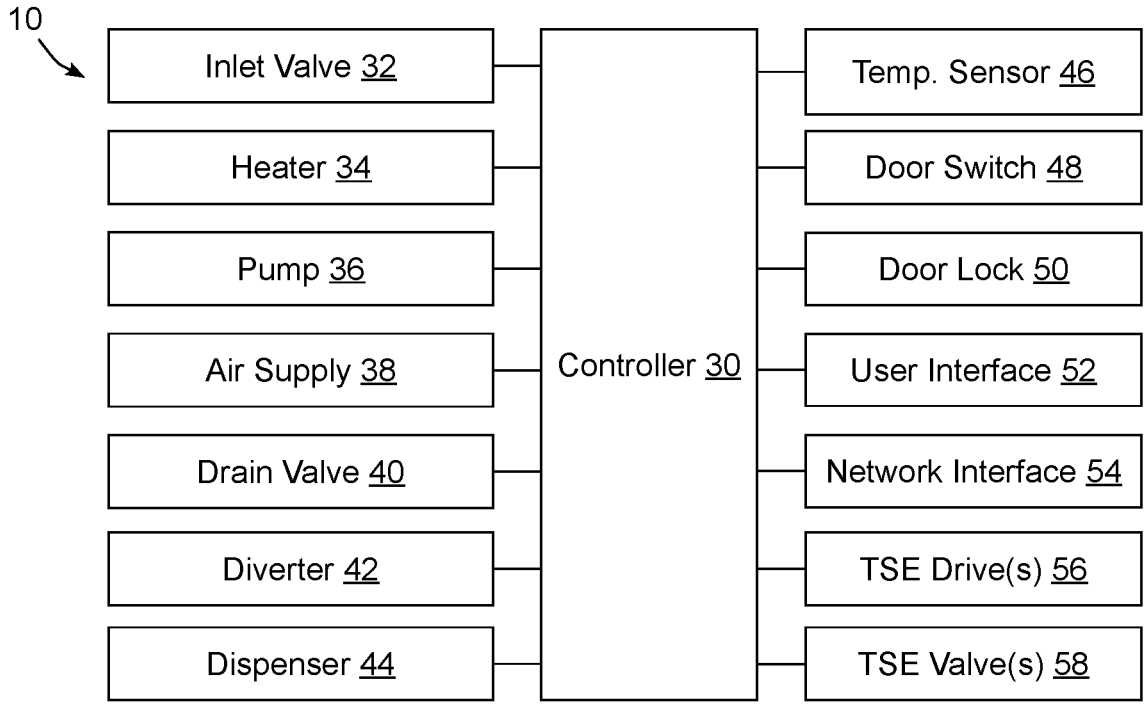
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
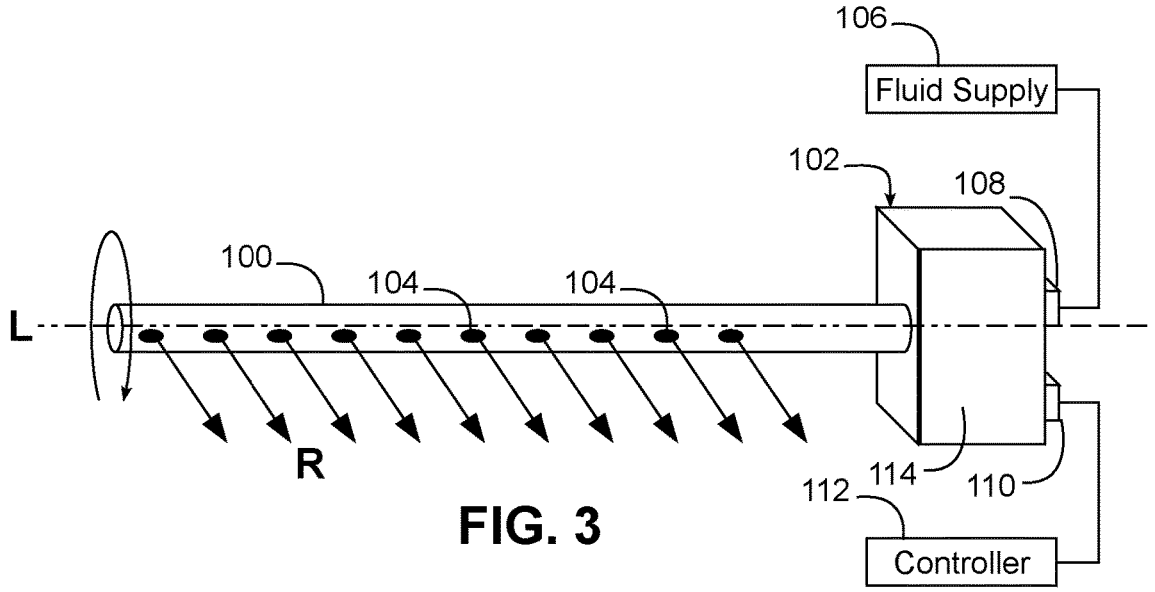
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc.

Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
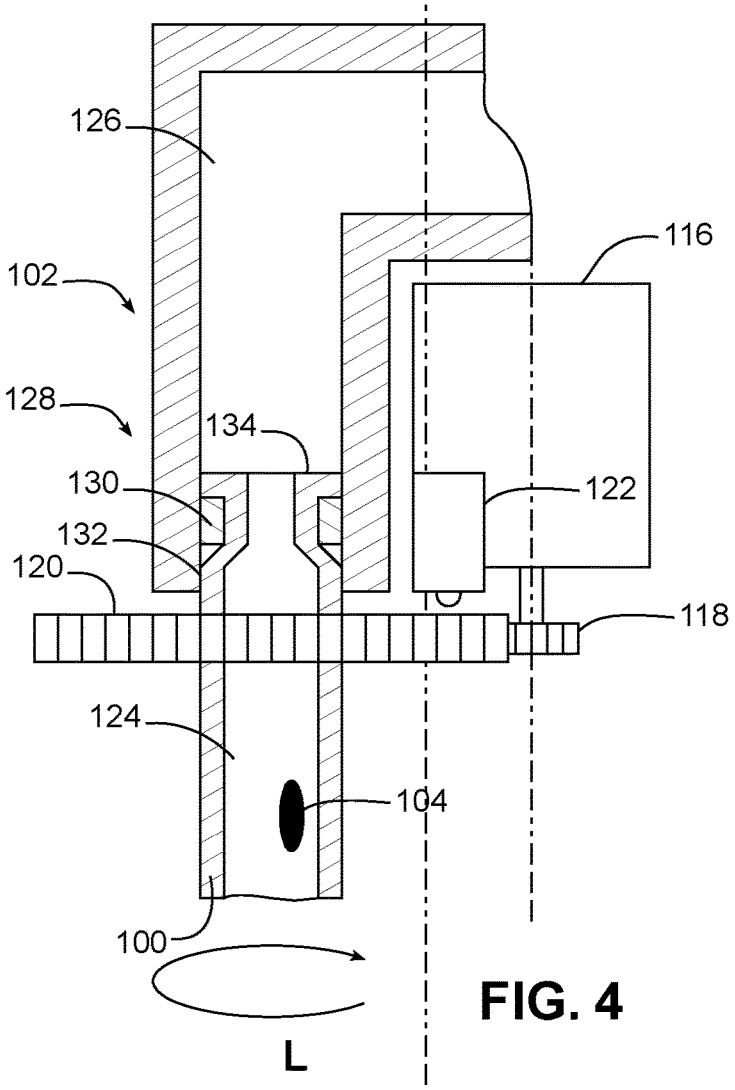
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pulley drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
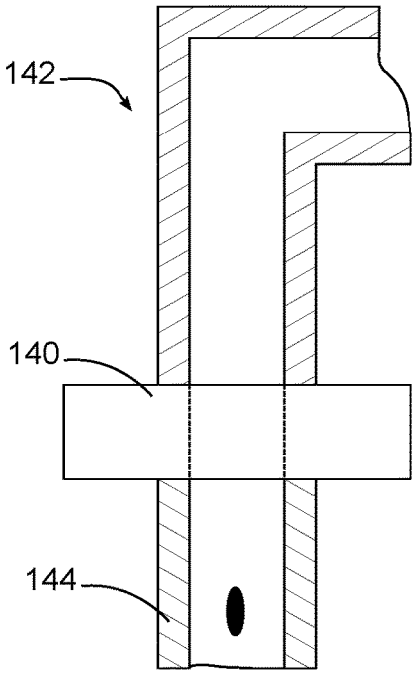
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
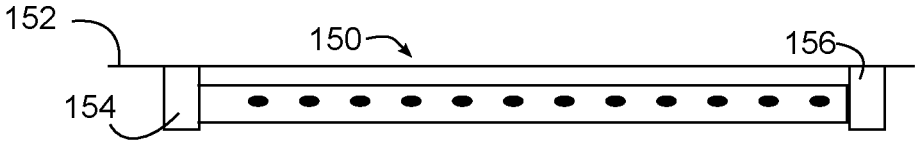
FIG. 6 is a functional top plan view of an example implementation of a wall-mounted tubular spray element and tubular spray element drive consistent with some embodiments of the invention.
Figure 7:
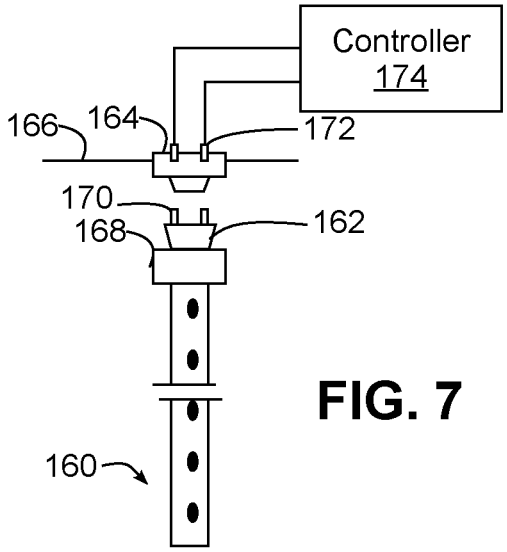
FIG. 7 is a functional top plan view of an example implementation of a rack-mounted tubular spray element and tubular spray element drive consistent with some embodiments of the invention.
Figure 8:
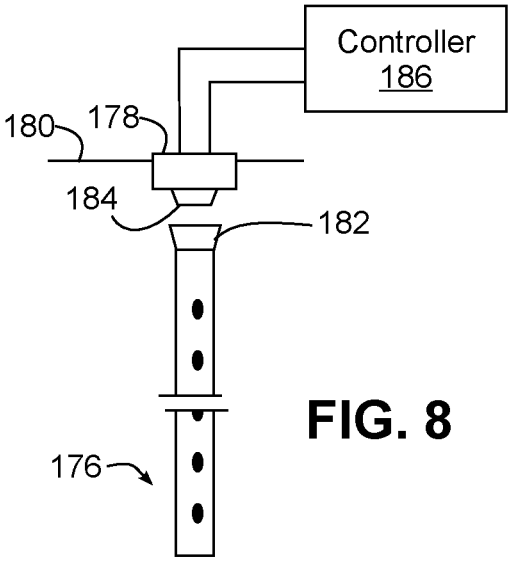
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
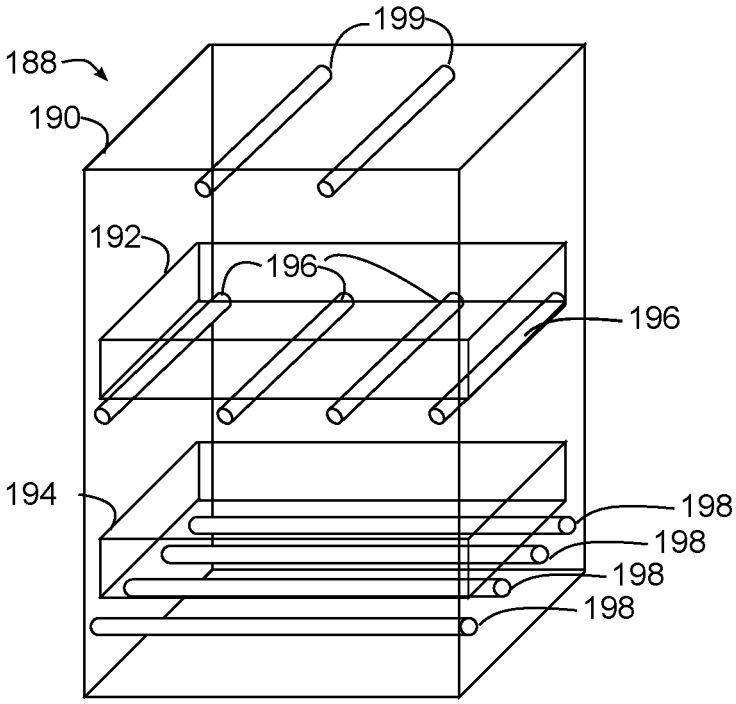
FIG. 9 is a functional perspective view of a dishwasher incorporating multiple tubular spray elements and consistent with some embodiments of the invention.
Figure 10:
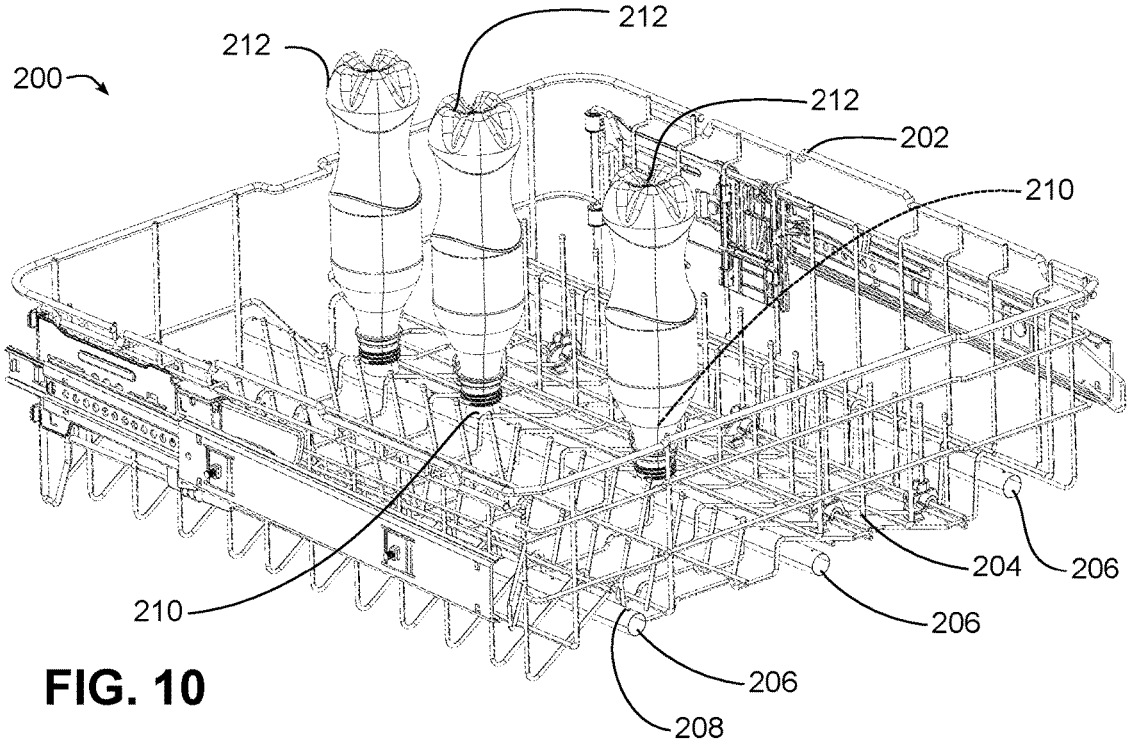
FIGS. 10 and 11 are perspective views of an example implementation of a dishwasher rack incorporating a tubular spray element drinkware washing system consistent with some embodiments of the invention.
Figure 11:
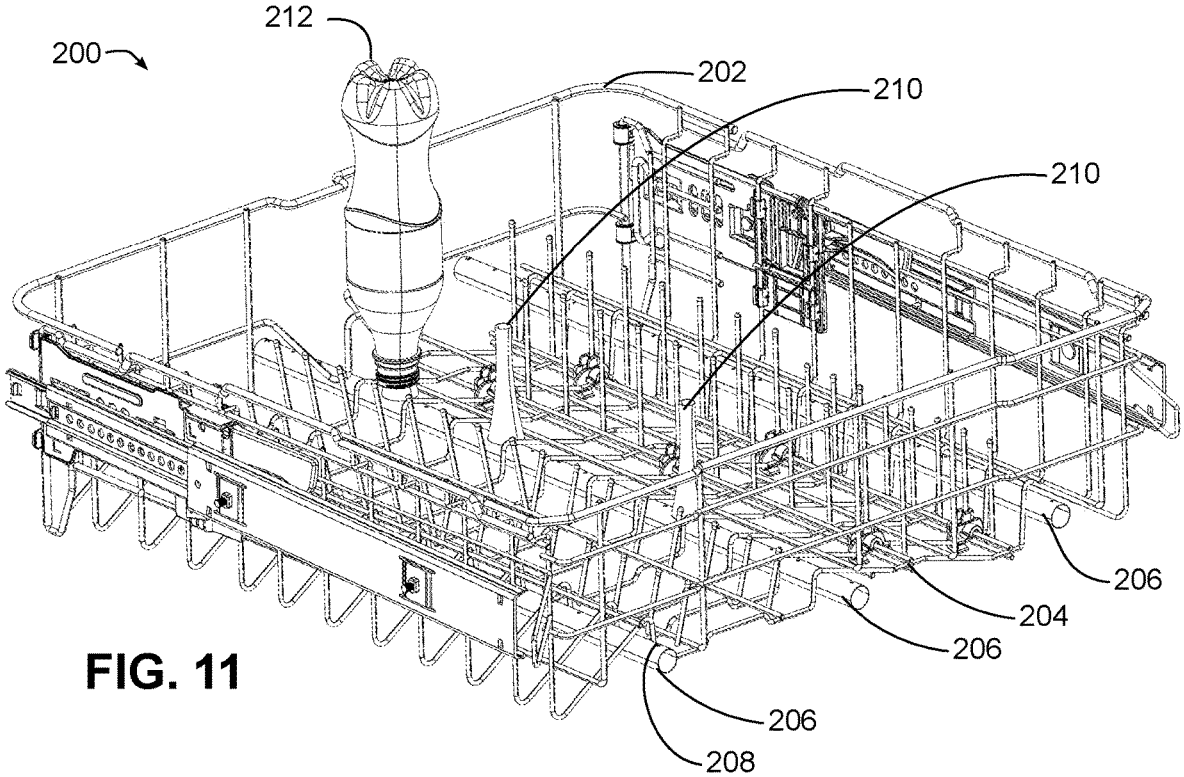
Figure 12:
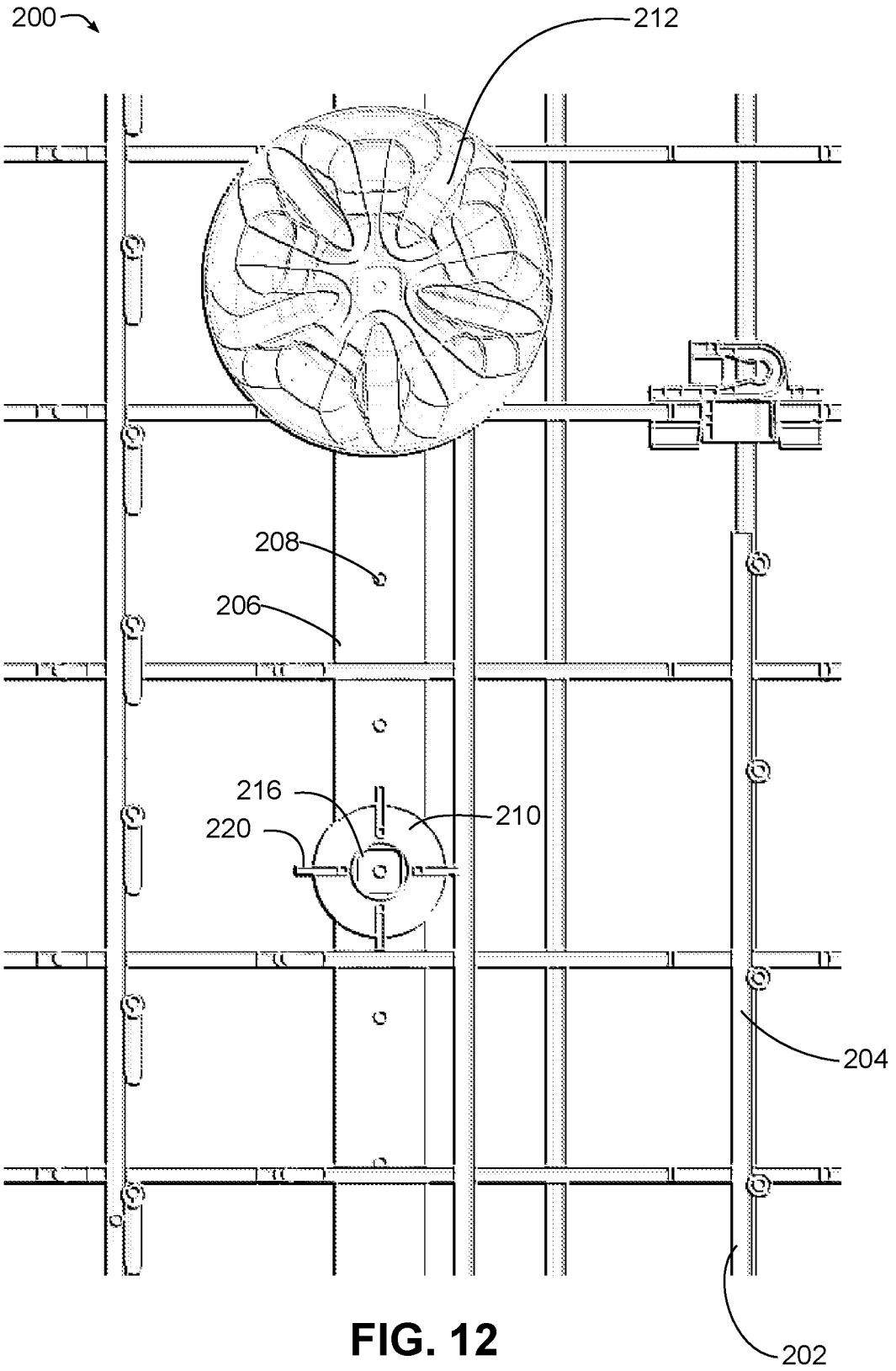
FIG. 12 is an enlarged top plan view of a portion of the dishwasher rack of FIGS. 10 and 11.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

In some embodiments consistent with the invention, a tubular spray element drinkware washing system may be supported to facilitate washing of various types of drinkware, including, for example, bottles (including baby bottles), cups, glasses, mugs, stemware, pitchers, containers, and other utensils generally including one or more interior regions for which washing may present challenges to conventional dishwashers. Bottles and similar drinkware, in particular, may have relatively small spouts or openings that can limit the ability to impinge the interior walls thereof using sprayers that emit wash fluid in a more distributed and unfocused manner, which is generally more suited for general washing purposes.

Embodiments consistent with invention, in contrast, may utilize one or more drinkware sprayers that are supported on a rack and physically spaced apart from a tubular spray element by a gap, but that are capable of receiving and then redirecting fluid sprayed by the tubular spray element into bottles or other drinkware items positioned over the drinkware sprayers. In particular, in the illustrated embodiment, a drinkware sprayer may include one or more outlets in fluid communication with a fluid collector that faces the tubular spray element and that is configured to receive a spray of fluid from the tubular spray element when the tubular spray element is rotated to a predetermined position. The drinkware sprayer is configured, e.g., by one or more internal channels, to route the received fluid out of the one or more outlets to wash an interior of a drinkware item that is positioned over the drinkware sprayer.

Turning to FIGS. 10-13, one manner of implementing a drinkware sprayer consistent with the invention is illustrated by dishwasher 200, which includes a rack 202 (e.g., an upper, middle or lower rack) formed of coated metal wire 204 and a plurality of tubular spray elements 206 disposed under the rack 202 for spraying utensils disposed in the rack during a wash operation. Each tubular spray element 206 includes a plurality of apertures 208, which in the illustrated embodiment are aligned circumferentially with one another such that all apertures of a tubular spray element emit fluid in the same general direction when the tubular spray element is disposed at a particular rotational position. It will be appreciated, however, that other aperture arrangements may be used in other embodiments as discussed above, so the invention is not limited to this particular tubular spray element design. Each tubular spray element 206 may be supported by rack 202, or alternatively, may be wall mounted in some embodiments.

Dishwasher 200 also includes a plurality of drinkware sprayers 210 that are supported by rack 202 for use in both supporting and washing various types of drinkware items, e.g., bottles 212. It will be appreciated that drinkware sprayers 210 may be configured to wash various types of drinkware, including bottles, baby bottles, cups, glasses, water bottles, mugs, travel mugs, tumblers, pitchers, etc. Moreover, while the drinkware sprayers may be designed in some embodiments for use specifically for drinkware, other types of utensils could be positioned proximate the sprayers to take advantage of the spray operations performed by such sprayers, including pots, pans, bowls, dishes, etc.

Each drinkware sprayer 210 in this embodiment is supported by rack 202, although such a sprayer may be disposed at other locations in a wash tub in other embodiments. Further, regardless of whether supported by a rack or not, each drinkware sprayer 210 is physically spaced apart from the tubular spray element such that a gap exists therebetween.

Figure 13:
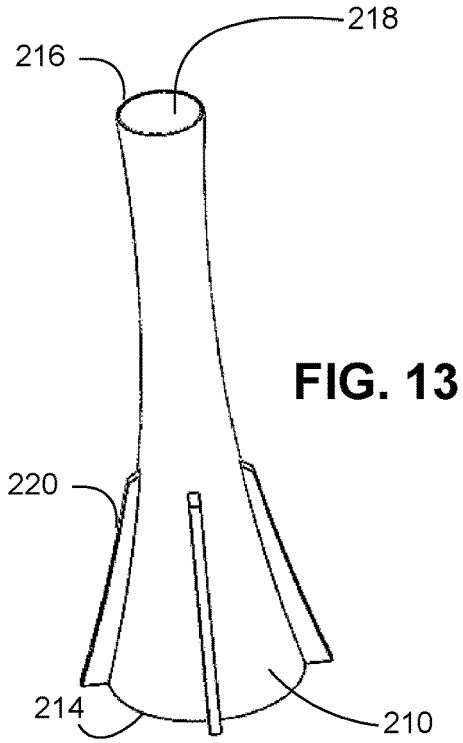
FIG. 13 is a perspective view of one of the drinkware sprayers illustrated in FIGS. 10-12.

With specific reference to FIG. 13, each drinkware sprayer 210 in the illustrated embodiment may be generally funnel-shaped, and may include a fluid collector 214 at an end proximate to a tubular spray element and facing the tubular spray element, an outlet 216 disposed at an opposite end thereof and facing away from the tubular spray element and towards the interior of a drinkware item, and an internal channel 218 placing the outlet 216 in fluid communication with fluid collector 214 such that fluid received by the fluid collector 214 from a tubular spray element is routed through the internal channel 218 and out of the outlet 216 to wash an interior of a drinkware item placed over the sprayer. In some embodiments, each drinkware sprayer 210 may also include one or more drinkware supports 220, e.g., a plurality of angled fins as illustrated in FIG. 13, which may be used to support the body of a drinkware item that is positioned over the drinkware sprayer. In the embodiment of FIGS. 10-13, for example, the drinkware supports may be configured to engage the spout or mouth of a drinkware item. It will also be appreciated that the drinkware supports may desirably not completely seal a mouth or opening of a drinkware item so that any fluid sprayed into the drinkware item can drain from the drinkware item.

Figure 14:
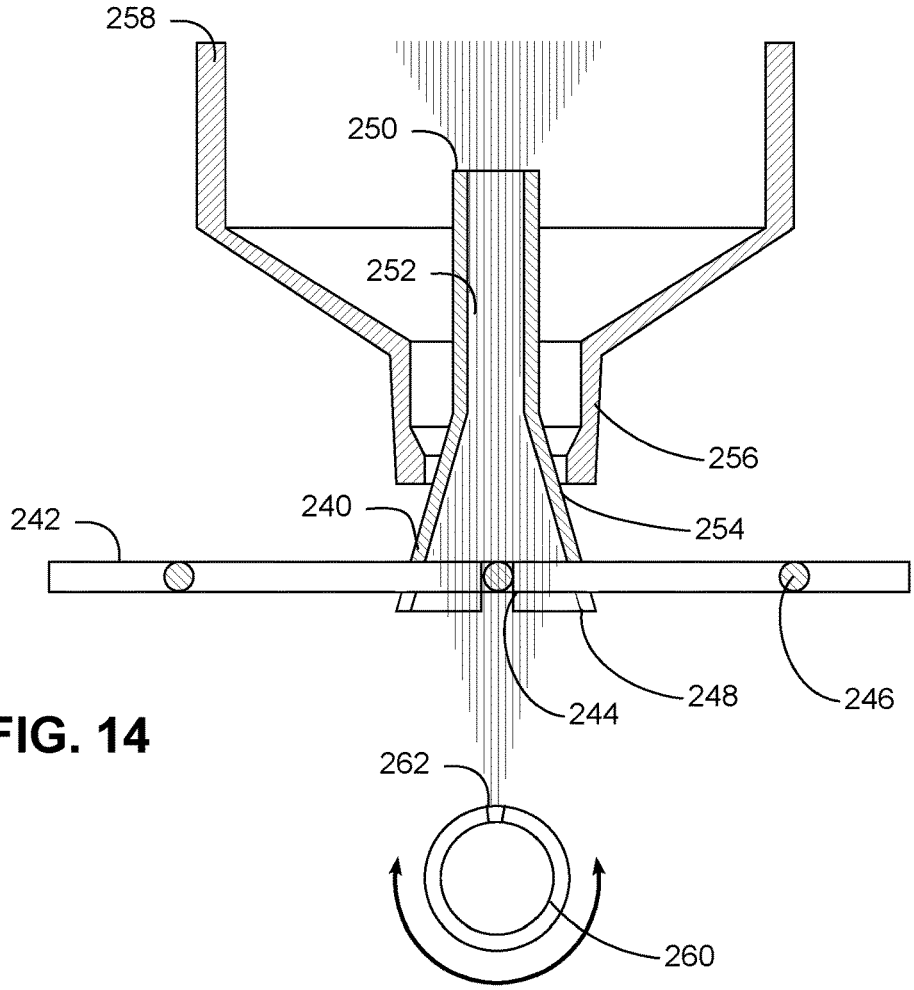
FIG. 14 is a side cross-sectional view illustrating a drinkware spraying operation consistent with some embodiments of the invention.

A drinkware sprayer consistent with the invention may be mounted in a number of different manners in different embodiments, e.g., through snap-fit couplings, through the use of fasteners, by being integrally molded into a supporting structure (e.g., where a rack is formed of plastic rather than coated wires), or in other suitable manners. FIG. 14, for example, illustrates another example design of a drinkware sprayer 240 that is snap fit onto a rack 242 using one or more snap fit recesses 244 that engage coated wires 246 of rack 242 to secure the drinkware sprayer 240 to the rack 242. Other manners of securing a drinkware sprayer to a rack or other structure in the wash tub of a dishwasher will be apparent to those of ordinary skill in the art having the benefit of the instant disclosure.

Similar to drinkware sprayer 210, drinkware sprayer 240 includes a downwardly-facing fluid collector 248 in fluid communication with an outlet 250 through an internal channel 252, along with a drinkware support 254, e.g., for supporting a spout or mouth 256 of a drinkware item 258. As illustrated in FIG. 14, fluid collector 248 is generally funnel-shaped and forms a generally horizontal opening that opens toward a tubular spray element 260. When in the rotational position illustrated in FIG. 14, one or more apertures 262 of tubular spray element 260 are able to spray fluid towards drinkware sprayer 240 such that the sprayed fluid is collected by fluid collector 248 and conveyed through internal channel 252 to outlet 250 for spraying the interior of drinkware item 258. In this embodiment, drinkware sprayer 240 and tubular spray element 260 are positioned relative to one another such that the optimum rotational position of tubular spray element 260 for directing fluid toward drinkware sprayer 240 is a substantially vertical or 12 o'clock position. However, as will be discussed in greater detail below in connection with FIG. 16, other relative positionings may be used in other embodiments, e.g., positionings where fluid is sprayed at an acute angle relative to a vertical position.

Figure 15:
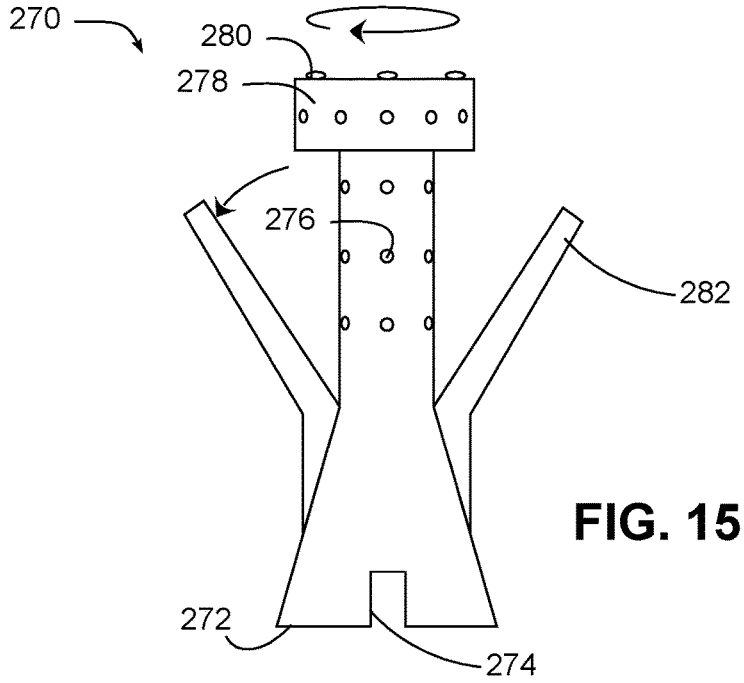
FIG. 15 is a side elevational view another example implementation of a drinkware sprayer to that of FIG. 14.

Drinkware sprayers consistent with the invention may utilize a number of different features in other embodiments. FIG. 15, for example, illustrates a drinkware sprayer 270 including a fluid collector 272, a snap fit coupling 274, and a plurality of outlets 276, 278, 280 for emitting spray in different directions. Outlets 276 are referred to herein as side outlets, as these outlets may spray outwardly towards the side interior surfaces of a drinkware item. Outlets 276 are also referred to herein as fixed outlets, as these outlets are not movable in operation. Outlets 278 and 280, however, are movable outlets positioned on a movable body (e.g., a rotatable body). Outlets 278 are side movable outlets that spray outwardly towards the side interior surfaces of a drinkware item, while outlets 280 are top movable outlets that spray upwardly towards the bottom interior surface of a drinkware item. In other embodiments, different numbers and/or configurations of outlets may be used, and various nozzle designs, e.g., fluidic nozzles, fan nozzles, stream nozzles, etc. may be used in different embodiments to provide differing spray patterns.

Drinkware sprayer 270 also is illustrated including one or more drinkware supports 282, which in some embodiments may be movable. It may be desirable, for example, to include movable drinkware supports to account for different types and/or widths of drinkware items. Drinkware sprayers in some embodiments may be designed for specific types of drinkware (e.g., baby bottles) and may include appropriate supports, clips, etc. to suitably secure the drinkware during a wash cycle. In addition, in some embodiments, a drinkware sprayer 270 may be configured to support drinkware in a non-vertical orientation, e.g., with a drinkware item laying on its side or at an incline.

Returning to FIGS. 10-12, it will be appreciated that a tubular spray element may be used to supply fluid to multiple drinkware sprayers in some embodiments. In some embodiments, for example, multiple drinkware sprayers may be arranged along an axis that is substantially parallel to the longitudinal axis of the tubular spray element, and the tubular spray element may have nozzles or apertures that are positioned along the tubular spray element at locations corresponding to the drinkware sprayers in order to direct sprays of fluid towards the fluid collectors of each of the drinkware sprayers when the tubular spray element is in a particular rotational position.

Figure 16:
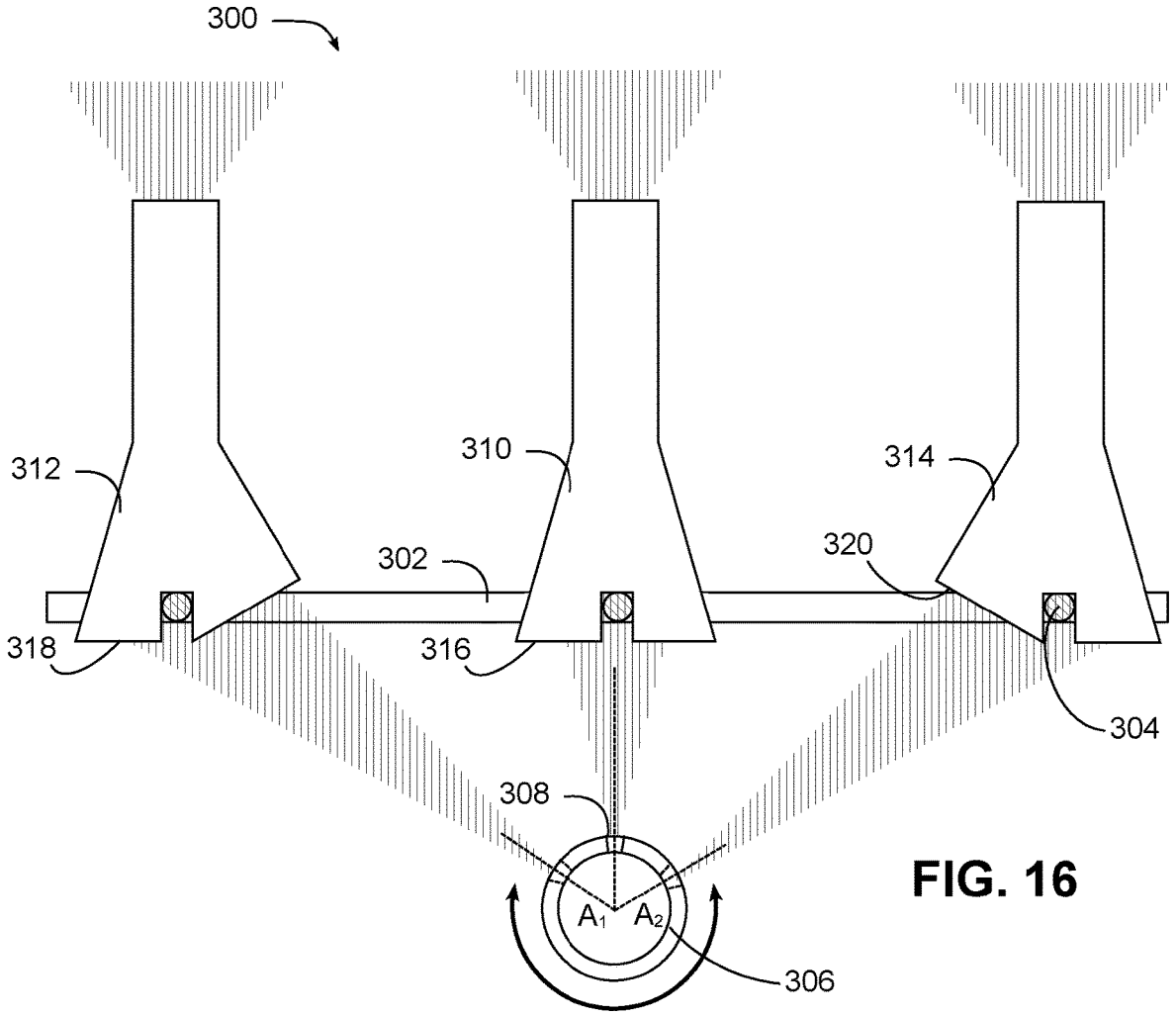
FIG. 16 is a side cross-sectional view illustrating drinkware spraying operations directed to multiple drinkware sprayers positioned at locations configured to receive wash fluid at different rotational positions of the same tubular spray element.

In addition, as illustrated in FIG. 16, in some embodiments, different drinkware sprayers may be located at different positions relative to a particular tubular spray element such that different drinkware sprayers may be supplied with fluid at different rotational positions of the tubular spray element. Specifically, FIG. 16 illustrates a dishwasher 300 including a rack 302 with wires 304, a tubular spray element 306 including a plurality of apertures 308, and a set of three drinkware sprayers 310, 312, 314. Drinkware sprayer 310 is similar to drinkware sprayer 210 of FIGS. 10-13, and is positioned relative to tubular spray element 306 to receive a spray of fluid from the tubular spray element when the tubular spray element is in a substantially vertical rotational position. Drinkware sprayers 312 and 314, however, are laterally offset on either side of drinkware sprayer 310 as well as tubular spray element 306 such that, for example, drinkware sprayer 312 is configured to receive a spray of fluid from the tubular spray element when the tubular spray element is rotated counter-clockwise to an angle or rotational position labeled $A_1$ in FIG. 16, which is acute relative to the substantially vertical rotational position for drinkware sprayer 310. Similarly, drinkware sprayer 314 is configured to receive a spray of fluid from the tubular spray element when the tubular spray element is rotated clockwise to an angle or rotational position labeled $A_2$ in FIG. 16, which is also acute relative to the substantially vertical rotational position for drinkware sprayer 310.

While drinkware sprayers 310, 312 and 314 may be identically configured in some embodiments, in other embodiments, the drinkware sprayers may be differently configured, e.g., to support other types of drinkware, or alternatively, as illustrated by the respective fluid collectors 316, 318, 320, to optimize fluid collection based upon the relative positioning of the drinkware sprayers to the tubular spray element, such that each fluid collector better faces and opens toward the tubular spray element to optimize fluid collection. It will also be appreciated that in some embodiments, multiple drinkware sprayers may be longitudinally spaced along a tubular spray element as well as laterally spaced as illustrated in FIG. 16, such that, in some embodiments, drinkware sprayers may be arranged in a two dimensional array. Other variations will be appreciated by those of ordinary skill in the art having the benefit of the instant disclosure.

In operation, the controller of a dishwasher incorporating drinkware sprayers consistent with the invention may be used to control a tubular spray element drive to discretely direct a tubular spray element to one or more particular rotational positions to direct fluid from a fluid supply towards one or more drinkware sprayers at desired points within a wash cycle. Moreover, due to the flexibility afforded by a tubular spray element design, the tubular spray element may, at other points in a wash cycle, spray other utensils in the wash tub, such that the same tubular spray element may be used for both drinkware spraying operations and non-drinkware spraying operations at different points in a wash cycle. Furthermore, in some embodiments, a single tubular spray element may be used to spray fluid onto utensils disposed in the same rack (but at different positions from the drinkware sprayer) and/or in a different rack from a drinkware sprayer.

In addition, in some embodiments, a controller may either perform drinkware spraying operations in separate phases of a wash cycle from non-drinkware spraying operations, or may perform drinkware spraying operations within non-drinkware spraying operations. For example, in some embodiments, drinkware spraying operations may be performed simply by temporarily pausing the rotation of a tubular spray element during a wash or rinse cycle and while the tubular spray element is directing fluid at a drinkware sprayer. It may be desirable, for example, to wash or rinse utensils by constantly rotating a tubular spray element 360 degrees for a period of time, or to oscillate the tubular spray element back and forth within a range of rotational positions for a period of time. Where drinkware spraying is desired, a controller may simply pause the tubular spray element for a few seconds when the appropriate rotational position is reached, and then return to the same rotational or oscillatory motion. Furthermore, it will be appreciated that drinkware spraying may only be supported in some wash programs, or may be selectable as an option by a user in some embodiments.

In addition, as noted above, in some dishwasher designs, tubular spray elements may spray air in addition to or in lieu of a wash fluid, so in some embodiments a drinkware sprayer may be supplied with a flow of air by a tubular spray element, e.g., to facilitate drying of the interior of a drinkware item.

Other modifications may be made to the illustrated embodiments without departing from the spirit and scope of the invention. Therefore, the invention lies in the claims hereinafter appended.

What is claimed is:

1. A dishwasher, comprising:

a wash tub;

a tubular spray element disposed in the wash tub and being rotatable about a longitudinal axis thereof, the tubular spray element including one or more apertures extending through an exterior surface thereof, and the tubular spray element in fluid communication with a fluid supply to direct fluid from the fluid supply into the wash tub through the one or more apertures;

a tubular spray element drive coupled to the tubular spray element and configured to rotate the tubular spray element between a plurality of rotational positions about the longitudinal axis thereof; and a drinkware sprayer positioned within the wash tub and physically spaced apart from the tubular spray element, the drinkware sprayer including one or more outlets and a fluid collector, wherein the one or more outlets are in fluid communication with the fluid collector and the fluid collector faces the tubular spray element, the fluid collector configured to receive fluid sprayed at the fluid collector by the tubular spray element when the tubular spray element is rotated to a predetermined rotational position, and route the received wash fluid out of the one or more outlets to wash an interior of a drinkware item that is positioned over the drinkware sprayer.

2. The dishwasher of claim 1, further comprising a controller coupled to the tubular spray element drive, wherein the controller is configured to control the tubular spray element drive to discretely direct the tubular spray element to the predetermined rotational position to direct fluid from the fluid supply towards the fluid collector.

3. The dishwasher of claim 2, wherein the controller is further configured to control the tubular spray element drive to discretely direct the tubular spray element to a different rotational position to direct fluid from the fluid supply towards one or more utensils in the wash tub other than the drinkware item.

4. The dishwasher of claim 3, wherein the drinkware sprayer is supported in a rack, and wherein the one or more utensils are in the rack at different positions than the drinkware item.

5. The dishwasher of claim 3, wherein the drinkware sprayer is supported in a first rack, and wherein the one or more utensils are in a second rack.

6. The dishwasher of claim 2, wherein the controller is configured to control the tubular spray element drive to rotate or oscillate the tubular spray element during a wash cycle, and to temporarily pause the tubular spray element drive during the rotation or oscillation of the tubular spray element when the tubular spray element is in the predetermined rotational position to direct fluid from the fluid supply towards the fluid collector.

7. The dishwasher of claim 1, wherein the rotational position is substantially vertical and the fluid collector has an opening that is substantially horizontal.

8. The dishwasher of claim 1, wherein the rotational position forms an acute angle relative to vertical and the fluid collector has an opening that opens toward the tubular spray element.

9. The dishwasher of claim 1, wherein the one or more outlets includes a top outlet that directs fluid towards a bottom interior surface of the drinkware item.

10. The dishwasher of claim 1, wherein the one or more outlets includes a side outlet that directs fluid towards a side interior surface of the drinkware item.

11. The dishwasher of claim 1, wherein the drinkware sprayer includes a plurality of drinkware supports configured to support a body of the drinkware item that is positioned over the drinkware sprayer.

12. The dishwasher of claim 11, wherein the drinkware sprayer is funnel shaped and the plurality of drinkware supports include angled fins that support a spout of the drinkware item.

13. The dishwasher of claim 1, wherein the tubular spray element is in fluid communication with an air supply to direct air from the air supply into the wash tub through the one or more apertures to dry the interior of the drinkware item.

14. A dishwasher, comprising:

a wash tub;

a rack supported in the wash tub and movable between loading and washing positions;

a tubular spray element disposed in the wash tub and being rotatable about a longitudinal axis thereof, the tubular spray element including one or more apertures extending through an exterior surface thereof, and the tubular spray element in fluid communication with a fluid supply to direct fluid from the fluid supply into the wash tub through the one or more apertures;

a tubular spray element drive coupled to the tubular spray element and configured to rotate the tubular spray element between a plurality of rotational positions about the longitudinal axis thereof; and a drinkware sprayer positioned within the wash tub and physically spaced apart from the tubular spray element, the drinkware sprayer including one or more outlets in fluid communication with a fluid collector that faces the tubular spray element, the fluid collector configured to receive fluid from the tubular spray element when the tubular spray element is rotated to a predetermined rotational position, and route the received wash fluid out of the one or more outlets to wash an interior of a drinkware item that is positioned over the drinkware sprayer, wherein the drinkware sprayer is supported by the rack.

15. The dishwasher of claim 14, wherein the rack is formed of coated metal wires, and wherein the drinkware sprayer snaps onto one or more of the coated metal wires.

16. The dishwasher of claim 14, wherein the drinkware sprayer is a first drinkware sprayer disposed at a first position on the rack, wherein the dishwasher further comprises one or more additional drinkware sprayers disposed at a plurality of additional positions on the rack, and wherein the one or more additional positions are arranged such that respective fluid collectors of the one or more additional positions are configured to receive fluid from the tubular spray element when the tubular spray element is rotated to the predetermined rotational position.

17. The dishwasher of claim 16, wherein the first position and the one or more additional positions are arranged along an axis that is substantially parallel to the longitudinal axis of the tubular spray element, and wherein the one or more apertures of the tubular spray element include a plurality of apertures that are positioned along the tubular spray element to direct sprays of fluid towards the fluid collectors of each of the first drinkware sprayer and the one or more additional drinkware sprayers.

18. The dishwasher of claim 14, wherein the predetermined rotational position is a first predetermined rotational position and the drinkware sprayer is a first drinkware sprayer disposed at a first position on the rack, wherein the dishwasher further comprises a second drinkware sprayer disposed at a second position on the rack, and wherein the second position is arranged such that a fluid collector of the second drinkware sprayer is configured to receive fluid from the tubular spray element when the tubular spray element is rotated to a second rotational position.

19. A dishwasher, comprising:

a wash tub;

a tubular spray element disposed in the wash tub and being rotatable about a longitudinal axis thereof, the tubular spray element including one or more apertures extending through an exterior surface thereof, and the tubular spray element in fluid communication with a fluid supply to direct fluid from the fluid supply into the wash tub through the one or more apertures;

a tubular spray element drive coupled to the tubular spray element and configured to rotate the tubular spray element between a plurality of rotational positions about the longitudinal axis thereof; and a drinkware sprayer positioned within the wash tub and physically spaced apart from the tubular spray element, the drinkware sprayer including one or more outlets in fluid communication with a fluid collector that faces the tubular spray element, the fluid collector configured to receive fluid from the tubular spray element when the tubular spray element is rotated to a predetermined rotational position, and route the received wash fluid out of the one or more outlets to wash an interior of a drinkware item that is positioned over the drinkware sprayer, wherein the one or more outlets includes a movable outlet disposed on a movable body.

20. The dishwasher of claim 19, wherein the movable body includes a rotatable body.

* * * * *